US008555510B2

(12) United States Patent
Fuerst et al.

(10) Patent No.: US 8,555,510 B2
(45) Date of Patent: Oct. 15, 2013

(54) ELECTRIC RAZOR HAVING INTEGRATED COOLING

(75) Inventors: Stefan Fuerst, Kronberg (DE); Martin Fuellgrabe, Bad Camberg (DE); Oliver Von Sartori-Montecroce, Kronberg (DE); Jan Langsdorf, Oberurser (DE); Uwe Schaaf, Alsbach (DE)

(73) Assignee: Braun GmbH, Kronberg (DE)

( * ) Notice: Subject to any disclaimer, the term of this patent is extended or adjusted under 35 U.S.C. 154(b) by 171 days.

(21) Appl. No.: 12/986,488

(22) Filed: Jan. 7, 2011

(65) Prior Publication Data

US 2011/0099814 A1 May 5, 2011

Related U.S. Application Data

(63) Continuation of application No. PCT/EP2009/004852, filed on Jul. 3, 2009.

(30) Foreign Application Priority Data

Jul. 8, 2008 (DE) ..... 10 2008 032 150

(51) Int. Cl.
*B26B 19/04* (2006.01)

(52) U.S. Cl.
USPC ..... 30/45; 30/43.91

(58) Field of Classification Search
USPC ..... 30/34.05, 34.2, 41, 537, 43.4–45
See application file for complete search history.

(56) References Cited

U.S. PATENT DOCUMENTS

| | | | | |
|---|---|---|---|---|
| 3,141,239 | A * | 7/1964 | Meyer et al. | 30/34.05 |
| 3,364,568 | A * | 1/1968 | Lowy | 30/34.05 |
| 3,364,588 | A | 1/1968 | Lowy | |
| 6,112,414 | A | 9/2000 | Andis et al. | |
| 2009/0049694 | A1 * | 2/2009 | Morris | 30/43.6 |

FOREIGN PATENT DOCUMENTS

| | | |
|---|---|---|
| CH | 390722 A | 4/1965 |
| DE | 101 47 286 A1 | 5/2003 |

OTHER PUBLICATIONS

International Search Report for PCT/EP2009/004852 dated Sep. 21, 2009.

* cited by examiner

*Primary Examiner* — Andrea Wellington
*Assistant Examiner* — Brendan Ayer
(74) *Attorney, Agent, or Firm* — Brent M. Peebles

(57) ABSTRACT

The invention relates to an electrically driven razor and an associated charging station, wherein at least one drivable cutting or shearing part is supported on a shearing head disposed on the razor housing and wherein at least one active thermocouple that can be electrically actuated is thermally coupled to a passive cooling element on the side that can be cooled relative to the ambient temperature. The passive cooling element in this arrangement is disposed having at least one free end section on or in the region of the shearing head, such that it contacts the skin of a user in shaving mode.

12 Claims, 4 Drawing Sheets

ELECTRIC RAZOR HAVING INTEGRATED COOLING

CROSS REFERENCE TO RELATED APPLICATION

This application is a continuation of prior co-pending International Application No. PCT/EP2009/004852, filed Jul. 3, 2009, designating the United State.

FIELD OF THE INVENTION

The present invention relates to an electrically driven razor having a razor housing and a shearing head arranged thereon, on which is movably supported at least one shearing or cutting part that can be driven by an electromotor arranged in the razor housing.

BACKGROUND OF THE INVENTION

Electrically operated razors are sufficiently known as such in the prior art. These typically have a shearing or cutting head on which cutting devices are fixed that are supported such that they can move in a translational, oscillating or rotating manner. Typical cutting devices have a top blade that is perforated or provided with apertures and a bottom blade, the top and bottom blade being capable of being moved relative to one another by means of an electrical drive, such that, when hairs enter into the apertures of the top blade, these hairs can be cut off by the cutting device.

During the shaving process, a majority of users of such electrically operated razors register a warm feeling on the skin to be shaved. This is often perceived by the user as uncomfortable and associated by the user with skin irritations. The perceptible warmth is produced in particular as a result of mechanical friction between the top and bottom blade.

Various cooling means for electrically operated razors are already described in the prior art. For example, U.S. Pat. No. 3,364,568 describes the use of an electrically operable cooling element which is thermally coupled via contact plates to the externally disposed shearing foil or to the top blade of the shearing or cutting head. In this way such portions of the razor which arrive in contact with the skin of the user during shaving can be actively cooled.

A similar approach is described in DE 101 47 286 A1. There it is additionally provided to blow cold air from an electrical cooling element onto the skin area to be shaved, by means of a fan.

However, the cooling by means of a flow of cooling air is likewise perceived by the user to be uncomfortable and disruptive. The cooling of a top blade, for instance a shearing foil, that arrives in contact with the skin to be shaved turns out to be problematic from a practical standpoint since the perforated foil is not particularly well suited for heat conduction, in particular due to its perforated design.

Moreover, it is to be noted that a top blade in the form of a shearing foil is already subject to a heating during operation of the razor. Therefore, if one wanted to achieve a cooling effect that can be sensed on the skin by means of a shearing foil, the heating of the shearing foil that is already present would first need to be counteracted by means of an active cooling, and a cooling function that goes beyond this would need to be provided in order for the user to be able to experience a cooling effect at all. The use of a cutting element that heats up during operation of the razor as a cooling element for skin areas turns out to be disadvantageous in this respect.

A cooling device for a razor, which cooling device contains a plurality of Peltier elements, is known from CH 390722 A. During shaving these thermocouples should contact the skin with what are known as their cold points without an interposition of an additional (passive) cooling element and should thereby cool the skin. These Peltier elements are arranged in each case around the periphery of the shearing system such that they are electrically insulated from one another. They must be electrically connected in each case to the power source, and moreover every single Peltier element must also be electrically insulated from the skin (for example via a corresponding coating) in order to prevent a shorting of the Peltier elements across the skin. This, of course, also degrades the heat transmission. Moreover, such a design is extremely complex and costly.

SUMMARY OF THE INVENTION

Compared with this, the present invention is based on the object of providing an improved and effective cooling concept for an electrically driven razor. The cooling means to be provided on the razor in this arrangement should operate as energy-efficiently as possible, and it should be possible to integrate them into existing razor geometries and to realize them inexpensively.

The electrically driven razor according to the invention has a razor housing and a shearing or cutting head arranged on the razor housing. At least one movably supported shearing or cutting part is arranged on said shearing or cutting head, which shearing or cutting part can be driven in an oscillating or rotating manner by an electromotor located in the razor housing. The razor also has an electrically operable, active thermocouple which, in operation, has a side that can be cooled relative to the ambient temperature and a side that can be heated relative to the ambient temperature.

A passive cooling element is thermally coupled to the side of the thermocouple that can be actively cooled, which passive cooling element comes to lie with at least a free end section on or in the region of the shearing or cutting head of the razor such that said free end section comes into contact with the skin of a user during operation of the razor. It is hereby essential that the cooling element is designed exclusively for heat or temperature transmission and not as a functional part of the razor or of the shearing or cutting part.

In this arrangement it is provided that the passive cooling element should be designed to be separate and independent of such functional parts of the razor which provide for the shortening of hairs and are designed for this purpose. With regard to its structure and its external shape, the passive cooling element is designed for an optimally fast and efficient heat transfer. It has at least external dimensions that correspond approximately to the dimensions of the top and bottom blades; however, this is with the difference that the passive cooling element is designed in the form of a solid one-piece member.

In particular due to its solid design, the passive cooling element can provide for an optimized and improved heat transmission compared to the prior art between the actively coolable thermocouple and the skin area to be cooled. Heat conduction losses between the active thermocouple and the skin area to be cooled can be minimized in this manner so that, given the use of comparable amounts of energy, a markedly improved cooling result on the skin can be achieved in comparison to a cooling mechanism which, for instance, cools the shearing foil of a razor. Owing to the use of the passive cooling element as a connection between the active thermocouple and the skin, the use of standard thermocouples, in particular commercially available electrothermal converters, is possible, and no thermocouples that are to be specially manufactured need to be used.

According to a first advantageous embodiment of the invention, it is provided that the passive cooling element with its end section facing away from the active thermocouple laterally surrounds or encloses the shearing part and/or the shearing head at least in parts. In particular, it is provided in this arrangement that this uncovered and coolable end section of the passive cooling element comes to be situated set back from the cutting devices arranged at the shearing or cutting part.

From this, it follows that, upon gliding along a skin area to be shaved, the free end of the passive cooling element is arranged leading and/or trailing a cutting part equipped with a top blade and a bottom blade.

The at least slightly set-back arrangement of the cooling element relative to the cutting device arranged at the shearing or cutting part can ensure a sufficient placement force and contact pressure force between the cutting device and the skin area to be shaved. The distance between the passive cooling element and the at least one cutting part in this arrangement is advantageously selected such that a skin area that is to be shaved can come into contact with both the cutting device and with the passive cooling element during a shaving process.

It is advantageous in particular if the shearing or cutting part does not come into contact with the skin area to be shaved exactly parallel to the surface normals, but rather when the razor and its shearing or cutting part are moved along the skin area at least slightly inclined relative to the surface normals of the skin area, which is the case for the most part in practice in a typical shaving process.

The cooling element that is at least slightly set back relative to the cutting device can arrive in contact with the corresponding skin area without difficulty to cool said skin area, in particular given such an at least slightly angled or inclined alignment of the shearing or cutting part or, respectively, of the entire razor housing relative to the surface normals of the skin.

Provision is made in particular, in this arrangement, that the cooling element with its free end section facing towards the skin of the user in operation of the razor completely or at least partially encloses or surrounds the shearing or cutting part or the entire shearing head. It can be provided in particular that the cooling element is in the form of a type of cooling web or cooling line.

According to an advantageous development of the invention, it is provided that the passive cooling element has a rounded projection at least at its free end section in the region of the shearing head, or is designed as a whole in the form of a rounded cooling web or cooling line. The passive cooling element in this region can in particular extend parallel to the longitudinal extension of the at least one cutting part or the at least one top blade.

Furthermore it can be provided that the passive cooling element is designed at least in some sections in the form of a mechanical receptacle for at least one spring element which provides for an elastic suspension of the cutting device or portions thereof at the shearing head or at the shearing or cutting part. It is conceivable in this respect to integrate the cooling element into a housing section of the shearing or cutting part. It is also possible and within the scope of the invention that a heat transmission to the shearing or cutting part can take place via the elastic suspension.

However, the predominant cooling effect is provided via the direct contact between the free end sections of the passive cooling element with the skin area that is to be shaved.

It is also within the scope of the invention to support the entire shearing head in a spring-loaded manner relative to the razor housing, in which arrangement the passive cooling element can then be connected rigidly either to the razor housing or to the shearing head.

According to a further supplementary or alternative embodiment, the passive cooling element can have at least one projection directed outward, which projection comes to be situated between a cutting part provided with a shearing foil as the top blade and an intermediate trimmer of the shearing head. In this arrangement it can be provided in particular that the cooling element is designed fork-like and has two projections that run substantially parallel to on another which are located in each case between one side of the intermediate trimmer and a shearing or cutting part that is arranged to the left and right of said intermediate trimmer.

In this embodiment it is provided in particular that the cooling element is arranged exclusively between two shearing or cutting parts which, viewed in the cross section, are located on the outside and that it optionally laterally encompasses an intermediate trimmer.

In the context of the invention it is additionally provided that the active thermocouple is designed in the form of a Peltier element and is electrically connected to a separate power source that is decoupled from the electromotor of the razor. In this arrangement it is provided in particular to design both the power source for the motor and the power source for the cooling in the form of rechargeable batteries which do not affect one another. The reason being that, when the thermocouple is implemented in the form of a Peltier element, its power consumption can be markedly higher than the power consumption of the electromotor.

By providing two independent rechargeable batteries, an increased operational reliability is achieved at least for the razor operation while the cooling function can optionally be dispensed with in cases of excessively long use without charging the batteries in between. In cases of particularly long intervals between two battery charging cycles, a long-term shaving function can be ensured in spite of a non-negligible power consumption of the Peltier element. The cooling function thus does not come at the expense of the shaving operating time of the razor.

Instead of a classical Peltier element, various other semiconductor elements utilizing the Seebeck effect can also be used accordingly.

Furthermore, it is provided that the active thermocouple is thermally coupled, on a side that is heated relative to the ambient temperature, to a cooling member. The cooling member heats up during operation of the thermocouple while the passive cooling member which is arranged on the other side of the thermocouple experiences a cooling. In this arrangement it is provided in particular to arrange the active thermocouple and the cooling member in the region of the main housing of the razor while the passive cooling element thermally covers a cooling zone between the active thermocouple and the cooling web, cooling strip or a cooling flange that is formed on the shearing head.

The arrangement of the cooling member on the outside of the razor housing has the advantage that the heat supplied to the cooling member in the operation of the thermocouple can be disc to the surrounding area relatively easily, quickly and efficiently.

Alternatively or in addition to this, it can be provided to arrange the cooling member in the middle of the razor housing, or even to embed functional parts of the razor in the cooling member for space reasons.

According to a further embodiment of the invention it is provided to provide a cooling air supply means at the razor, with which cooling air supply means the cooling member heated during operation can be actively cooled. For this it is conceivable to provide a fan and a cooling air channel by means of which cooling air can be applied to the cooling member during operation.

According to a particularly advantageous embodiment of the invention it is provided that the cooling member has a latent heat accumulator. The latent heat accumulator is provided with what is known as a phase change material which utilizes the enthalpy of reversible thermodynamic state changes of the material or of the latent heat accumulator medium. The latent heat accumulator medium can perform, for example, a phase change between solid and liquid. In particular paraffins or special salts, optionally even water, are considered to be suitable latent heat accumulator materials.

It can be provided in particular to design the housing of the latent heat accumulator to be at least partially transparent and to illuminate it from inside the razor housing. As a result of a phase change, the optical transmission behavior of the heat accumulator material can change, such that an optical monitoring capability with regard to the status of the latent heat accumulator can be provided to the user as well.

In addition to a design as a latent heat accumulator, a cooling member filled with water is also conceivable in principle. In this arrangement the relatively high heat capacity and/or heat of fusion of water can be utilized.

According to a further embodiment of the invention it is provided that the cooling member is designed to accommodate a fluid which vaporizes due to the action of the heat that can be achieved by the active thermocouple. It could thus be provided to design the cooling member as a fluid or water vaporizer in such a way that same has a material that conducts heat well and is porous, which material is impregnated, for example, with cold water before shaving. During operation of the thermocouple this cooling member would experience a heating, during which process, however, heat can be extracted from the overall system via the beginning vaporization of the water and the drying of this cooling member.

Furthermore, it is provided that the temperature of the active thermocouple can be regulated so as to be adjustable by the user, and that the thermocouple is designed to selectively cool and heat the passive cooling element and accordingly designed as having the opposite action of the cooling member. A direction reversal of the cooling effect can in particular be advantageous in order to actively cool the cooling member before startup of the razor, in order for same not to be heated to an excessively high temperature during operation.

Furthermore, by means of the reversal of the cooling effect, a heating of the passive cooling element that is thermally coupled to the shearing head can be achieved. Such a heating is advantageous in connection with a cleaning procedure of the shearing and cutting parts that are arranged directly adjacent, which shearing and cutting parts are for example impregnated with an aqueous or alcohol-containing cleaning fluid with the aid of a cleaning station and can be dried better after cleaning under the action of the heat quantity provided by the passive cooling element.

It is also conceivable to reverse the cooling circuit during such a cleaning procedure, for instance in order to heat the cleaning fluid, which can advantageously affect the cleaning as such.

According to a further independent aspect, the invention relates to a charging station for an electrically driven razor, wherein the charging station has a receptacle for a razor housing and is equipped with charging means to charge at least one electrical rechargeable battery arranged in the razor housing.

In this arrangement it is also provided that the electrical coupling means—for instance in the form of spring-loaded contact pins—provide not only a power supply for the rechargeable batteries that are to be charged and are located in the razor housing but moreover are designed for coupling of an active thermocouple of the razor that is arranged in the razor housing to a control and regulating unit of the charging station. In this way a razor placed in the charging station, which razor is provided with an active thermocouple, optionally also with a cooling member, can already be cooled to a predetermined temperature level in the charging station before startup of the razor.

In this arrangement, in particular the heat accumulator or cooling member provided on the razor can be cooled. It is also conceivable that the charging station is designed to discharge energy from the cooling member which is heated as a result of a shaving process and to convert this energy back into electrical energy. In this arrangement it can be provided in particular to feed the stored heat from the cooling member back into the charging station via the Peltier element that is coupled to said cooling member and to use this stored heat to charge the batteries located in the housing of the razor.

The charging station or its control and regulating unit are designed in particular to cool by means of the thermocouple a cooling member that is thermally coupled to the active thermocouple of the razor, and at the same time to heat a passive cooling element thermally coupled with the thermocouple, which cooling element extends up to or into a shearing head of the razor, for cleaning purposes. Such a coupled cooling or heating of cooling member and cooling element can be advantageously integrated into a charging process of the razor or be temporally coupled therewith.

BRIEF DESCRIPTION OF THE DRAWINGS

Additional objectives, features and advantageous embodiments of the invention are described using the following exemplary embodiments, with reference to the drawings. All described and graphically depicted features form the subject matter of the present invention, both alone and in any meaningful combination, even independent of the Patent Claims and their dependencies on one another.

The figures show as follows.

DETAILED DESCRIPTION OF THE INVENTION

Figure 1:
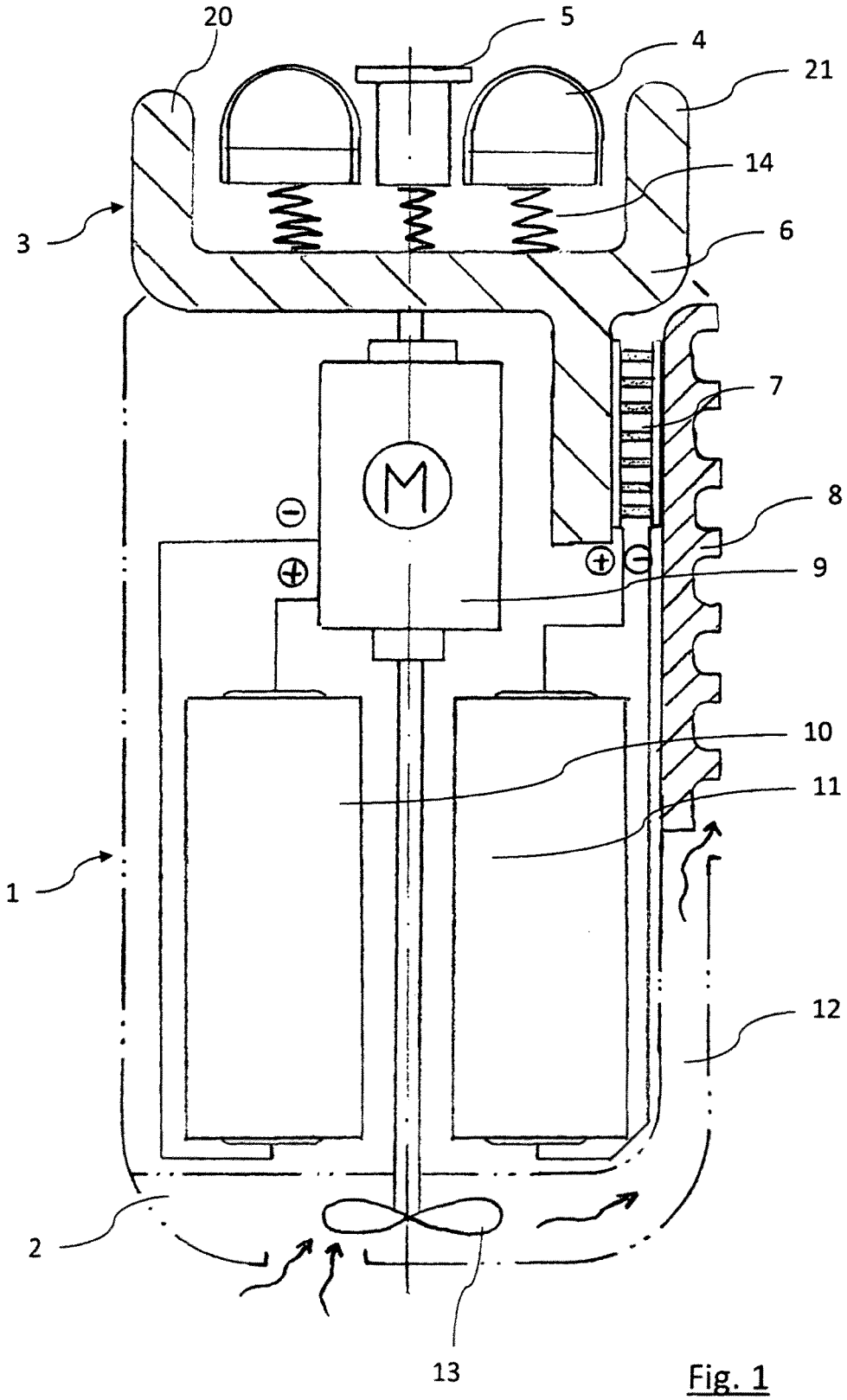
FIG. 1 is a schematic illustration of an electric razor having a passive cooling member coupled to a thermocouple.

In the following description with the aid of the Figures, the same reference characters are selected in each case for parts that correspond to one another.

The razor 1 shown schematically in FIG. 1 has a housing 2 and a shearing or cutting head 3 arranged at the upper end section of the housing 2. Two rechargeable batteries 10, 11 that are independent of one another are accommodated in the housing, the rechargeable battery 10 driving a motor 9 which mechanically operatively interacts with the shearing or cutting parts 4, 5 arranged on the shearing or cutting head 3. The shearing and cutting parts 4, 5 are spring-loaded by means of compression springs 14 relative to a passive cooling element 6 designed in the form of a peripheral cooling strip.

The cooling element 6 has rounded projections or webs 20, 21 that are set back relative to the free end sections of the shearing parts 4, 5 and project to the sides of the electrically operated shearing and cutting parts 4, which rounded projections should come into contact during shaving with the skin surfaces to be shaved. Within the razor housing the passive cooling element 6 is thermally coupled to an active, electrically operable thermocouple 7 which can be designed in the form of a Peltier element.

The thermocouple 7 can be operated by means of a separate rechargeable battery 11 in order to be able to provide operating power for a sufficiently long shaving time via the rechargeable battery 10, independent of the cooling function of the razor, which has a comparably high power consumption.

On the thermocouple 7 a cooling member 8 is arranged at the side facing away from the passive cooling element 6. According to the embodiment according to FIG. 1, this cooling member has cooling fins facing outward, which cooling fins can be supplied with cooling air by a cooling fan 13 which can be driven by means of the motor 9 from within the housing and by a subsequent cooling channel 12. The cooling member 8 and the cooling channel 12 can be designed such that an air flow that is barely noticeable to the user can escape from the housing 2, such that ultimately the shaving comfort for the user is only imperceptibly negatively affected by the air flow.

The passive cooling element 6 can in particular be designed in the form of a cooling strip or cooling flange and surround all shearing or cutting parts 4, 5 of the shearing or cutting head 3 of the razor 1. Aluminum or zinc are considered to be suitable materials for the passive cooling element 6, for example, wherein the module 6 can be produced by means of aluminum or zinc die casting. In this case it is provided in particular that the passive cooling element 6 is designed in the form of a solid component, essentially without voids, in order to be able to provide a sufficient heat transfer.

In this arrangement it is also provided that the cooling element 6 that is peripheral at least in some regions and that laterally surrounds the shearing head 3 at the same time acts its rounded projections or cooling strips as a kind of force-limiting mechanical stop in the operation of the razor. For example, the cooling strip or the passive cooling element 6 can be designed such that it takes up the structural space between the cutting parts 4, 5 and/or functions as a mount for the cutting parts, in particular for the intermediate part 5.

In the initial position of the razor shown in FIG. 1, the upwardly facing projections 20, 21 of the passive cooling element 6 are set back somewhat relative to the upper free end sections of the shearing and cutting parts 4, 5. Since the shearing and cutting parts 4, 5 are supported in a spring-loaded manner, these can move back somewhat when a counter-pressure is applied by the skin to be shaved, such that the passive cooling element 6 with its projections 20, 21 that are formed web-like comes in contact with the skin to be shaved.

At the same time, due to the embodiment of the cooling webs 20, 21, a compression of the spring elements 14 can be limited to a certain degree, such that a contact pressure between the shearing and cutting parts 4, 5 and the skin that is optimal for the shaving can be provided via the selection of corresponding spring constants for the compression springs 14 and via the geometric design of the cooling strips 20, 21 and the cutting and shearing parts 4, 5.

The integration of the Peltier element 7 in the razor housing, in particular at a lateral edge of the razor housing, provides an effective shock protection for the Peltier element, in particular if the entire razor slips out of the hand of a user and falls to the floor. This moreover promotes the sealing of the unit against dirt and water or moisture.

Figure 2:
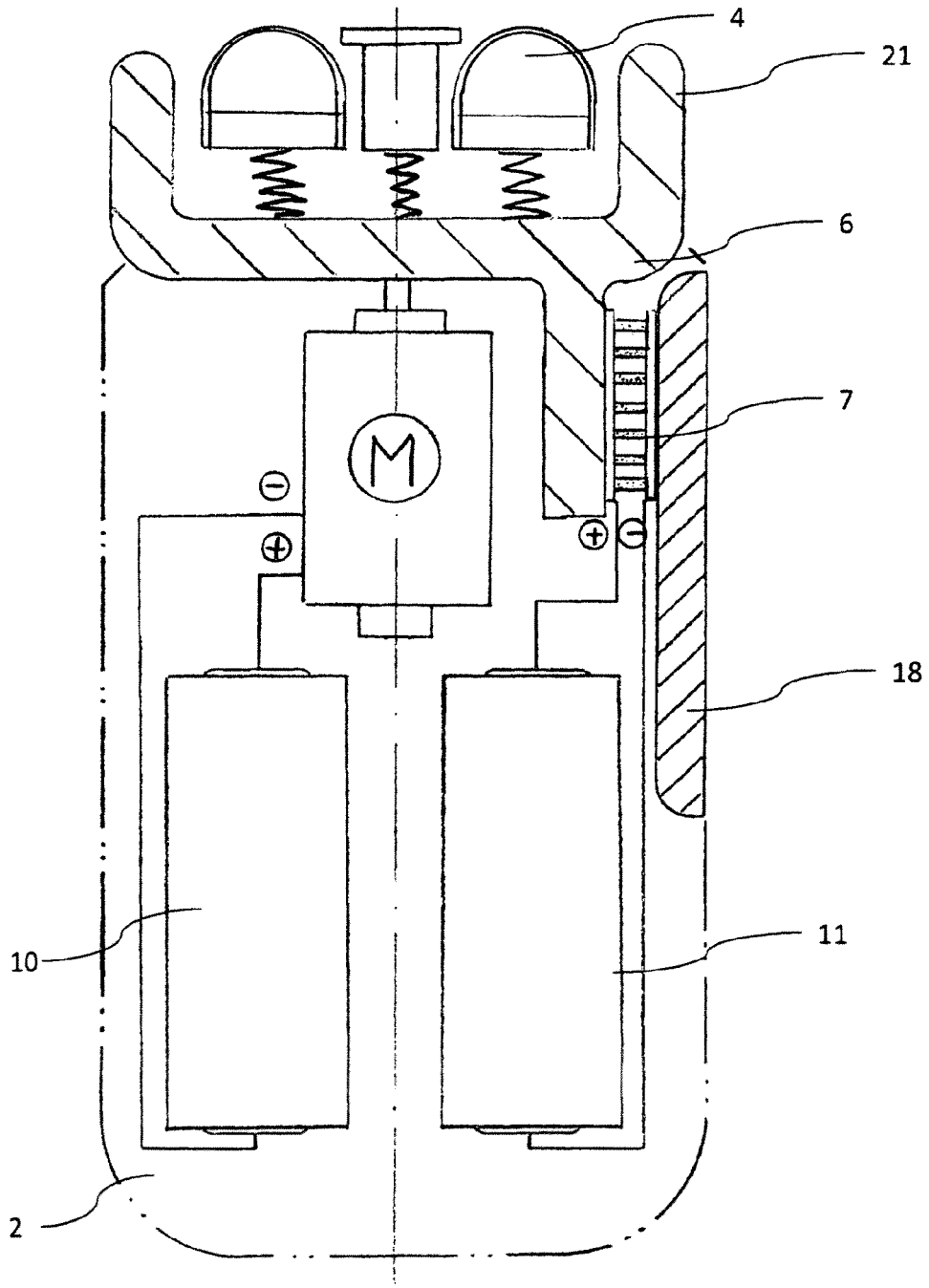
FIG. 2 is an embodiment of an electric razor having a latent heat accumulator.

The embodiment according to FIG. 2 has a latent heat accumulator 18 instead of a cooling member 8 provided with cooling fins. The latent heat accumulator 18 can, for example, be filled with paraffin and be designed to be transparent at least in some regions. It is additionally conceivable that the latent heat accumulator 18 or its housing is illuminated from the inside, such that an optical effect that is perceptible to the user is created upon liquefaction of the latent heat accumulator material in the operation of the thermocouple 7, which optical effect can signal to the user the present operating state of the Peltier element 7 and/or of the latent heat accumulator.

Instead of a latent heat accumulator, it is also conceivable to fill the cooling member 18 with water or to design the cooling member itself in the form a porous material that takes up a fluid, for example water, that vaporizes during the operation of the Peltier element 7.

By means of the Peltier element 7, an individual cooling that can be individually adapted to the desires and needs of the user can be achieved. In particular, the cooling temperature of the cooling member 6 can be set by means of an operating element that can be adjusted by the user.

The use of a Peltier element as an active thermocouple also additionally enables a reverse cooling or heating function. If the Peltier element is operated in pulses or with reversed polarity, for instance, a heat accumulator 18, 8 that is hot after the shaving process can also be actively cooled. In addition to this it is conceivable to let those elements—cooling element 6 and cooling member 8—that are thermally coupled to the Peltier element 7, cool by themselves to room temperature and in doing so utilize the Seebeck effect to produce electrical energy.

This is advantageous in particular if the razor 1 is stoned, in particular after use, in a charging station, which can possibly be coupled to a cleaning device. It is conceivable in this respect that the electrical energy that can be generated by the Peltier element 7 can be transferred into the charging station and there can be used to charge the batteries 10, 11 of the razor 1. It is additionally conceivable that, by means of a control and regulating device provided for this purpose, the charging station cools the cooling members 8, 18 down to a predetermined temperature before startup of the razor, such that during operation of the razor a correspondingly large cooling capacity can be provided.

In embodiments in which the charging station is provided with a cleaning device in the same way, in which the shearing and cutting parts 4, 5 of the razor are immersed in a cleaning fluid, it is also conceivable to operate the cooling element 6, 16 as a heating element in order to heat up the cleaning fluid which washes around the shearing and cutting parts 4, 5, such that overall a better cleaning capability can be achieved.

Figure 3:
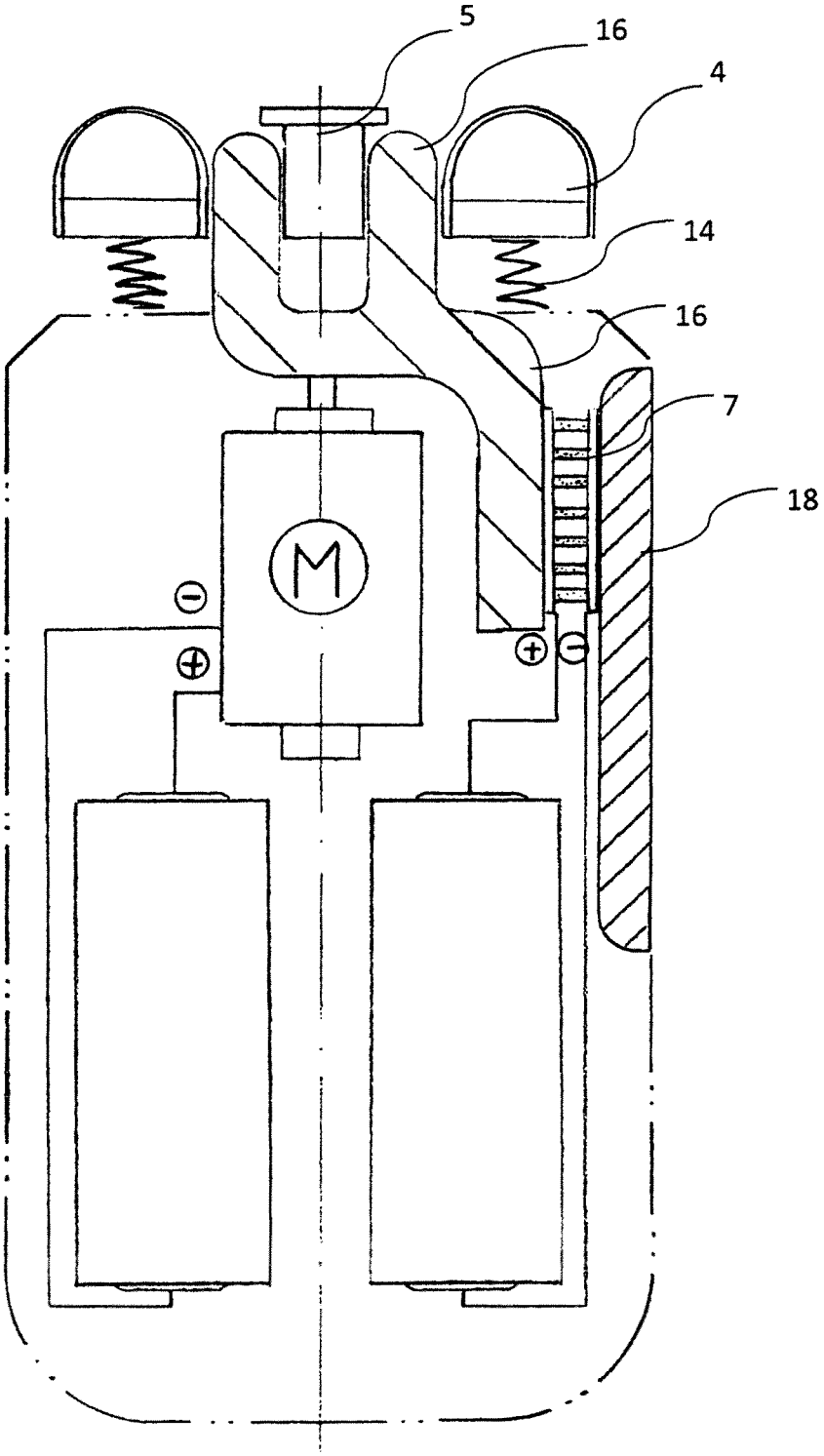
FIG. 3 is an additional embodiment of the razor, wherein an intermediate trimmer of the shearing head is encompassed by two webs of a passive cooling element.

An alternative embodiment of a passive cooling element 16 is shown in FIG. 3 which, with its freely upwardly projecting end section which is designed fork-like, encompasses an intermediate trimmer 5 of the shearing head. Instead of a peripheral cooling strip, like it is shown in FIGS. 1 and 2, the cooling element is arranged between the intermediate trimmer and the shearing or cutting parts 4 that come to be situated on the outside. These but also the intermediate trimmer 5 are supported spring-loaded on the shearing head and can be displaced relative to the cooling element, such that during shaving the shearing or cutting parts 4 move back at least slightly due to the counter-pressure that can be applied by the skin of the user, whereby a direct contact between cooling element 16 and skin can be achieved.

Figure 4:
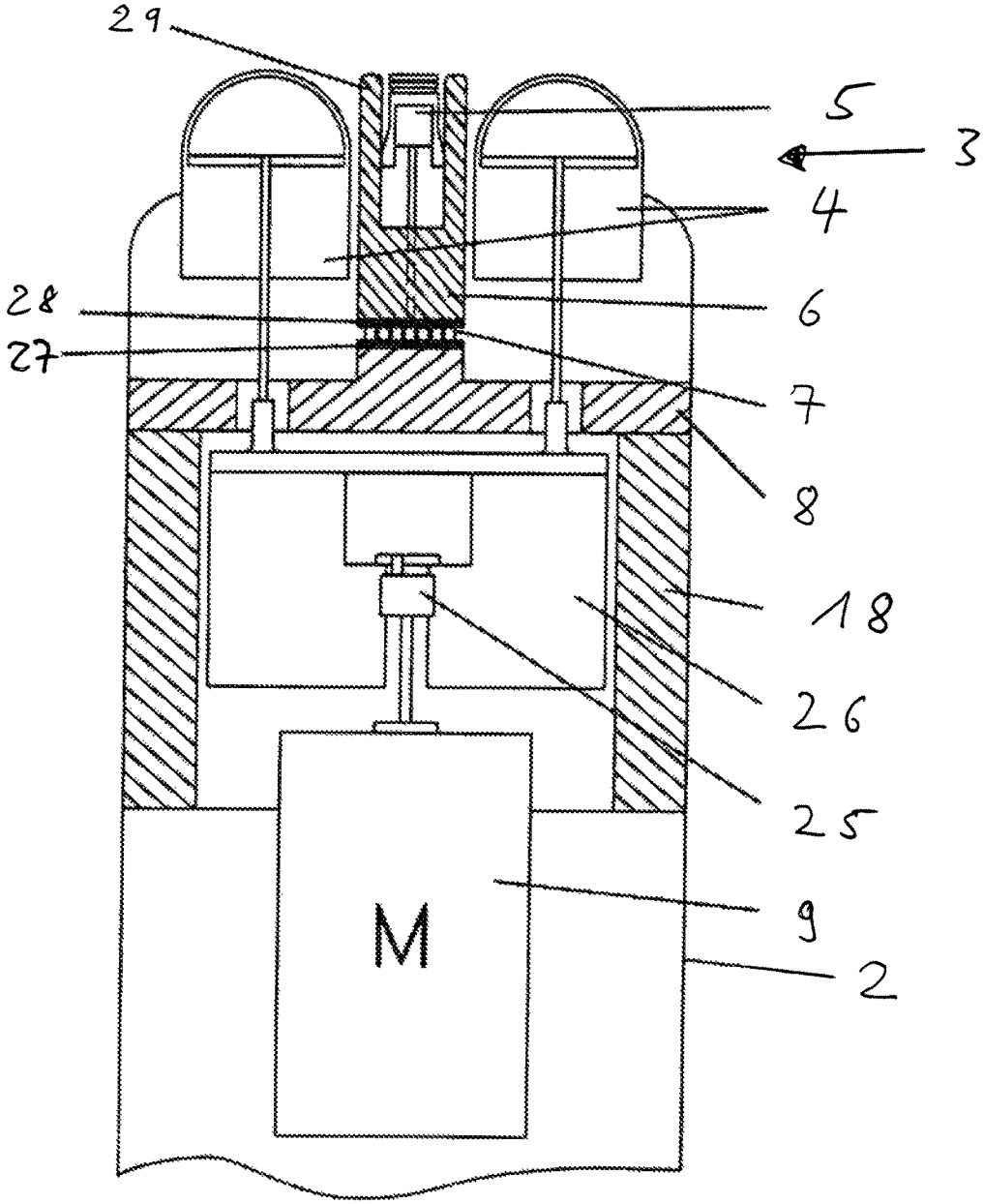
FIG. 4 shows a practical embodiment of the invention that is characterized by optimal efficiency of the cooling device.

According to FIG. 4, the electromotor 9, the drive shaft of which has a cam 25, drives the movable shearing elements of the shearing part 4 or cutting part 5 in a known manner via oscillating bridges. The front face of the housing 2 that faces towards the shearing head 3 is designed as a cooling member 8 that is connected in a sealing manner to the upper housing section which is designed in the form of a cooling member or heat accumulator 18. The two components 8 and 18 are preferably made of aluminum and form the device chassis. Same is particularly stable on the one hand but can moreover absorb a significantly large amount of excess heat of the thermocouple 7, which is in particular implemented in the form of a Peltier element, and subsequently discharge said excess heat into the environment.

At least one thermocouple 7 or also a plurality of thermocouples are fixed in series on the cooling member 8, specifically with the warm side 27, in the region between the two shearing parts 4. A bar-shaped, passive cooling element or cooling strip 6 is arranged on the cold side 28 of the thermocouple 7, which cooling strip 6 extends upward between the two shearing parts 4. The vertical extension is selected in this arrangement such that the upper end section 29 can contact the skin to be shaved during the shaving process. The cooling strip 6 at the same time represents a mechanical safety guard if the razor should fall down suddenly. The cutting part 5 is arranged within a groove of the cooling strip 6.

The shearing parts 4 and/or the cutting part 5 and/or the cooling strip 6 can be elastically connected to the housing 2 in order to ensure an optimal adaptation to the contour of the skin to be shaved.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An electrically driven razor, having a razor housing and having a shearing head arranged on the razor housing, on which shearing head at least one shearing or cutting part is supported that can be driven by an electromotor arranged in the razor housing, wherein at least one electrically operable active thermocouple is provided; characterized in that a side of the thermocouple, which side can be cooled relative to the ambient temperature, is thermally coupled to a passive cooling element, wherein the passive cooling element comes to lie with at least one free end section on or in the region of the shearing head such that it comes into contact with the skin of a user during operation of the razor, and further, wherein the passive cooling element is designed in the form of a receptacle for at least one spring element providing an elastic suspension of the shearing or cutting part on the shearing head.

2. The razor according to claim 1, wherein the passive cooling element laterally encompasses the shearing or cutting part at least in some sections.

3. The razor according to claim 1, wherein the passive cooling element comes to lie with its free end section set back from the shearing or cutting part, which end section faces towards the skin of the user during operation of the razor.

4. The razor according to claim 1, wherein the passive cooling element has at least one rounded projection in the region of the shearing head, which projection extends parallel to the longitudinal extension of the at least one shearing or cutting part.

5. The razor according to claim 1, wherein the passive cooling element has at least one outwardly directed projection which comes to lie between a foil cutter and an intermediate trimmer of the shearing head.

6. The razor according to claim 1, wherein the active thermocouple is designed in the form of a Peltier element.

7. The razor according to claim 1, wherein the active thermocouple is thermally coupled to a cooling member with a side that is heated relative to the ambient temperature.

8. The razor according to claim 7, wherein the cooling member and can be cooled by means of a cooling air feed device during operation of the razor.

9. The razor according to claim 7, wherein the cooling member has a latent heat accumulator.

10. The razor according to claim 7, wherein the cooling member is designed to absorb a fluid which vaporizes due to the heating action that can be achieved by the active thermocouple.

11. The razor according to claim 7, wherein the thermocouple is coupled to the cooling member and/or to the cooling element so as to form a gas-tight and/or moisture-tight sea.

12. The razor according to claim 1, wherein the temperature of the active thermocouple can be regulated, and the thermocouple is designed for selective cooling and heating of the passive cooling element.

* * * * *